United States Patent [19]

Pohlenz et al.

[11] Patent Number: 4,976,433

[45] Date of Patent: Dec. 11, 1990

[54] RACKET, AND MORE PARTICULARLY A TENNIS RACKET

[75] Inventors: Hans Pohlenz, Boppard; Günter Wagner, Nörtershausen, both of Fed. Rep. of Germany

[73] Assignee: Stabilus GmbH, Koblenz-Neuendorf, Fed. Rep. of Germany

[21] Appl. No.: 358,178

[22] Filed: May 26, 1989

[30] Foreign Application Priority Data

May 28, 1988 [DE] Fed. Rep. of Germany ..... 3818152

[51] Int. Cl.[5] ..... A63B 51/12

[52] U.S. Cl. ..... 273/73 E; 273/73 J; 273/73 G

[58] Field of Search ..... 273/73 R, 73 C, 73 D, 273/73 E, 73 F, 73 G, 73 H, 73 J, 73 K, 73 L

[56] References Cited

U.S. PATENT DOCUMENTS

| | | | |
|---|---|---|---|
| 4,613,138 | 9/1986 | Haythornthwaite | 273/73 E |
| 4,690,405 | 9/1987 | Frolow | 273/73 J |
| 4,765,621 | 8/1988 | Game | 273/73 E |
| 4,783,072 | 11/1988 | Haar | 273/73 E |

FOREIGN PATENT DOCUMENTS

| | | | |
|---|---|---|---|
| A0225042 | 6/1987 | European Pat. Off. . | |
| A2513567 | 10/1976 | Fed. Rep. of Germany . | |
| A3229981 | 2/1984 | Fed. Rep. of Germany . | |
| U8706273 | 11/1987 | Fed. Rep. of Germany . | |
| 3129207 | 2/1983 | German Democratic Rep. | 273/73 E |
| 3229981 | 2/1984 | German Democratic Rep. | 273/73 E |
| 2157181 | 10/1985 | United Kingdom | 273/73 E |

*Primary Examiner*—Paul E. Shapiro
*Assistant Examiner*—Raleigh W. Chiu
*Attorney, Agent, or Firm*—Brumbaugh, Graves, Donohue & Raymond

[57] ABSTRACT

According to an illustrative example of this invention, a gas spring is incorporated into a tennis racket. This gas spring is connected with some of the strings such as to maintain a predetermined tension within the strings irrespective of possible elongation of the strings during operation.

31 Claims, 4 Drawing Sheets

RACKET, AND MORE PARTICULARLY A TENNIS RACKET

BACKGROUND OF THE INVENTION

The stringing of rackets consists of longitudinal and transverse strings. A preset string tension is chosen according to the wishes of the player. After the racket has been strung, there is no provision for any adjustment in the spring tension. A disadvantage is that in the course of time, the tension of the strings diminishes and expensive retensioning has to be carried out by an expert using an external tensioning device into which the racket is inserted.

OBJECT OF THE INVENTION

It is a primary object of the present invention to provide a racket in which the tension of the strings can be maintained constant over a prolonged period.

A further object of the invention is to make the string tension variable by the possibility of arbitrary adjustment.

SUMMARY OF THE INVENTION

In view of the above mentioned objects, a racket for ball games, and more particularly a tennis racket, comprises a frame. This frame surrounds an internal area. A plurality of strings extend along said internal area and are under tension. At least part of said strings are operatively connected to at least one tensioning device for maintaining said tension of said strings. This tensioning device is a component of said racket during the operation thereof and is supported by said racket.

With such a racket, the tension of the strings remains constant for a long period even if the strings are elongated or the frame is deformed. The tension of the strings can be made more resilient so that the rebound effect of the racket is reduced. The tensioning device can be damped so as to further modify the rebound effect so that players do not suffer from what is referred to as a tennis elbow.

A plurality of strings may be connected to a common tensioning member provided outside the frame. This tensioning member is operatively connected to the tensioning device so that a plurality of strings can be tensioned by one common tensioning device.

The strings of said plurality of strings can be guided through a plurality of bores of the frame member, said bores being substantially parallel to said internal area so that the positioning of the strings is obtained a well-known, way without the necessity of the tensioning device to fulfilling a positioning function for the respective strings.

In accordance with well-known tennis rackets, the racket may comprise a handle member having an axis and being connected with the frame member by an intermediate portion. In tennis language the frame member is called the head of the racket and the intermediate portion is called the heart of the racket.

In such racket with a handle member, the internal area has a longitudinal axis substantially parallel to the axis of the handle member and a transverse axis substantially perpendicular to the axis of the handle member. A first group of strings extend substantially parallel to the longitudinal axis and a second group of strings extend substantially parallel to the transverse axis. At least part of the strings of the first group of strings may be operatively connected to the tensioning device. It is to be noted that one can connect all strings and even the transversely extending strings to one or a plurality of tensioning devices. In view of a simple and economic solution and in keeping the weight of the racket within desired limits, it is preferred, to connect only part of the strings to the tensioning device.

If a tennis racket of classic design is used, the strings of the part of strings of said first group can be connected to a tensioning member located adjacent to said intermediate portion, which tensioning member is operatively connected to the tensioning device. This has been found to be more easily construction and more economical, because the tensioning member can be easily located adjacent to the intermediate portion.

In such construction, the part of strings of said first group can be guided through bores of a respective portion of the frame member towards the tensioning member. The bores can be substantially parallel to the internal area such as to reduce the friction of the strings within these bores and to fully control the tension of the strings exclusively by the spring force of the tensioning device.

According to a most preferred embodiment of the invention, the tensioning member is located within a cavity of the intermediate portion adjacent to a respective portion of the frame member, and the tensioning device is located within a cavity of one of said handle member and said intermediate portion on the side of said tensioning member remote from the frame member. By such a design one can maintain the classic appearance of a tennis racket.

It has been found that while pull-type tensioning devices can be also used, thrust-type tensioning devices are particularly useful. Pull-type tensioning devices exert tension by contracting their length and thrust-type tensioning devices exert tension by extending their length. As thrust-type tensioning devices there may be particularly used gas springs. While pull-type gas springs are also available, thrust-type gas springs are much more simple and economical. In a thrust-type gas spring, the gas pressure within the spring cylinder exerts a pushout force against the piston rod and/or piston to generate the "thrust" of the tensioning device. In a pull-type gas spring, the gas pressure exerts an inward force on the piston and/or piston rod to generate the "pulling" force of the tensioning device. When using thrust-type tensioning devices, a design may be used in which the axis of the tensioning device is substantially parallel to the longitudinal axis. A first end portion of the tensioning device, closer to the frame member, is supported by the intermediate portion, while a second end portion more remote from the frame member is operatively connected to the tensioning device. This operative connection can be established in that the second end portion of the thrust-type tensioning device acts onto the tensioning member through at least one pulling member extending between the tensioning member and the second end portion. More particularly, the tensioning member is connected with said second end portion by two pulling plates substantially parallel to said internal area and accommodating said thrust-type tensioning device therebetween. In such case the first end portion of the thrust-type tensioning device can be supported on the intermediate portion by a support bar supported on the intermediate portion and extending between the pulling plates across the cavity of the intermediate portion substantially parallel to the transverse axis. The resulting design is still highly adapted for being accommodated within the racket such that the classic appearance thereof is not substantially altered.

While advantages are already obtained if the tensioning device is only adapted for maintaining the tension of the strings substantially constant over an extended period of life, additional advantages are obtained if the thrust-type tensioning device is adjustable as to its tensioning force. In cases of a thrust-type tensioning device the adjustment of the tensioning force can be obtained as follows: the thrust-type tensioning device has an axis substantially parallel to the longitudinal axis of the frame. A first end portion of the thrust-type tensioning device closer to the frame member is supported by the intermediate portion and a second end portion more remote from the frame member is connected to the tensioning member by two pulling plates substantially parallel to the internal area. These pulling plates accommodate the thrust-type tensioning device therebetween. The first end portion of the thrust-type tensioning device is supported on the intermediate portion by a support bar supported on said intermediate portion and extending between the pulling plates across the cavity of the intermediate portion in a direction substantially parallel to said transverse axis. The first end portion of the thrust-type tensioning device is adjustable along said axis of the thrust-type tensioning device with respect to the support bar. This adjustment can be made possible in that the first end portion of the thrust-type tensioning device is supported on said support bar by a base member having a U-shaped fork-portion. The fork legs are substantially parallel to the internal area and engage the support bar on both sides thereof such as to prevent rotation of the base member. A screw member has an end face substantially perpendicular to the axis of the thrust-type tensioning device and engages the support bar. This screw member is axially movable with respect to the base member by a screwing movement about the axis of the thrust-type tensioning device. The screw member is accessible through a window of at least one of the pulling plates.

For preventing bending moments in the tensioning device, the second end portion of the tensioning device may be pivotally connected with the pulling plates.

A further design based on the use of a thrust-type tensioning device is as follows: the thrust-type tensioning device has an axis substantially parallel to the longitudinal axis of the frame. A second end portion more remote from said frame member is supported by one of the handle member and the intermediate portion. A first end portion of the thrust-type tensioning device is connected by at least one flexible pulling member with the tensioning member. This flexible pulling member is guided from the first end portion of the thrust-type tensioning device towards the tensioning member via at least one deflection member fixed to one of the handle member and the intermediate portion.

In this design an adjustment of the spring force can be easily obtained in that the second end portion of the thrust-type tensioning device is adjustable along the axis of the handle member. The adjustment means for effecting such adjustment may extend along the axis of said handle member and may have an operating member adjacent to the end of the handle member remote from the frame member.

A gas spring to be used according to this invention comprises a cylinder member with a cavity therein and a piston rod member sealingly extending through one end of the cylinder member. The cavity receives a volume of pressurized gas. The pressurized gas exerts an outwardly directed spring force onto the piston rod member (thrust-type gas spring). The piston rod member has a smaller cross-sectional area and said cavity has a larger cross-sectional area. The ratio of said smaller and said larger cross-sectional areas can be such that an axial movement of the piston rod member with respect to the cylinder member in response to elongation of the respective strings during operation does not substantially alter the pressure of the pressurized gas within the cavity. Nevertheless, the spring force may be altered in accordance with the wishes of the respective players by provision of adjustment means for adjustment of the axial position of the piston rod member with respect to the cylinder member. Such axial adjustment can result in a relatively large variation of the relative axial positions of the cylinder member and the piston rod member. By increasing the length of the piston rod member within the cavity, the pressure may be increased and vice versa.

Besides the possibility of increasing the spring force of a gas spring by relative movement of the cylinder member and the piston rod member, other possibilities exist for adjustment of the spring force which may be used according to the invention.

In order to vary the damping characteristics of the racket, the gas spring or other tensioning device may be provided with damping means.

When stringing the racket, it is desirable to have the tensioning member in a fixed stringing position. Therefore, locking means are provided for locking the tensioning member in a stringing position. The locking means may be released after stringing has been completed such that from now the tension is maintained by the tensioning device. A most simple way of locking the tensioning member is to provide abutment means particularly between the tensioning member and the frame, which abutment means fix the stringing position of the tensioning member. A soon as stringing has been completed, the tensioning member may be lifted from the frame member by the tensioning device.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

BRIEF DESCRIPTION OF THE DRAWINGS

The invention will be explained in greater detail hereinafter with reference to an embodiment shown in the accompaying drawings, in which.

DESCRIPTION OF THE PREFERRED EMBODIMENTS

Figure 1:
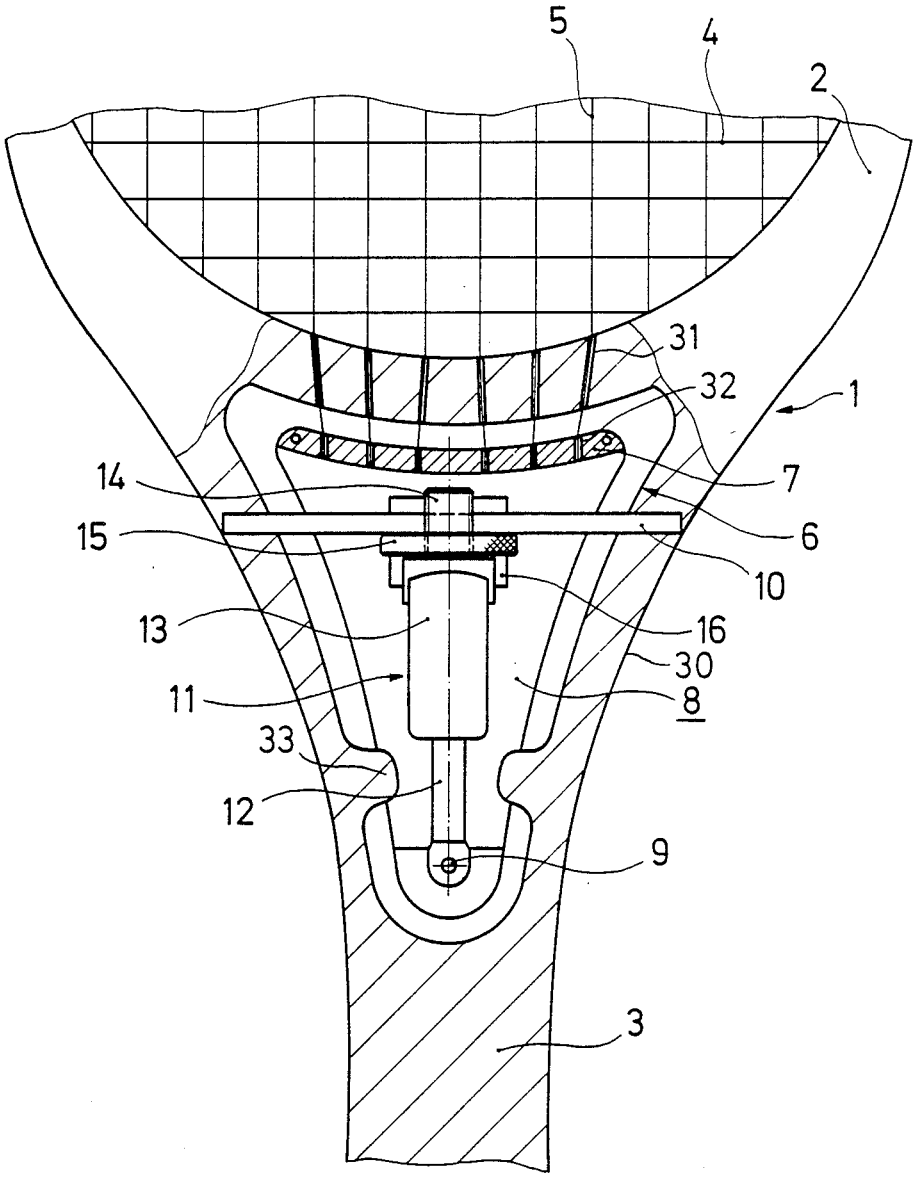
FIG. 1 shows the middle part of a tennis racket according to the present invention.

The racket 1 shown in FIG. 1 consists of a racket head or racket frame 2 and a handle 3 connected to the frame 2 by an intermediate portion 30. Stringing of the racket head 2 consists of the transverse strings 4 and the longitudinal strings 5, some of these longitudinal strings 5 extending through bores 31 in the racket frame and being connected to a tensioning member in the form of a bridge. In this tensioning member 7 there are provided anchoring bores 32 to receive the longitudinal strings 5. A box 8 is connected to the tensioning member 7. This box 8 consists of two pulling plates 8*a* and 8*b* releasably interconnected with each other. This box 8 receives a gas spring 11. The end of the piston rod 12 is articulatingly connected to a bearing pin 9 at the lower end of the box 8. A base member 14 is fixed on the upper end of the container 13 of the gas spring 11. This base member 14 is provided with a bifurcated section 14*a*, the fork members of which are located on both sides of a support bar 10. On the bifurcated section 14*a* there is provided an external thread 14*b*. A nut member 15 is screwable on the external thread 14*b* and has an end face 15*a* which engages the support bar 10. The support bar 10 is supported in the intermediate section 30 as can be seen from FIG. 1 and runs across a cavity 6 of the intermediate portion 30 which accommodates the box 8. The nut 15 is shaped as a setting wheel which is accessible through windows 16 of the pulling plates 8*a* and 8*b*. The setting wheel 15 serves for adjustment of the spring force of the gas spring 11. The box 8 is prevented from rotation by projections 33 engaging between the pulling plates 8*a* and 8*b* of the box 8. The box 8 is formed by the two pulling plates 8*a* and 8*b* which are of similar construction. The pulling plate 8*a* is integral with the bridge or tensioning member 7.

Figure 3:
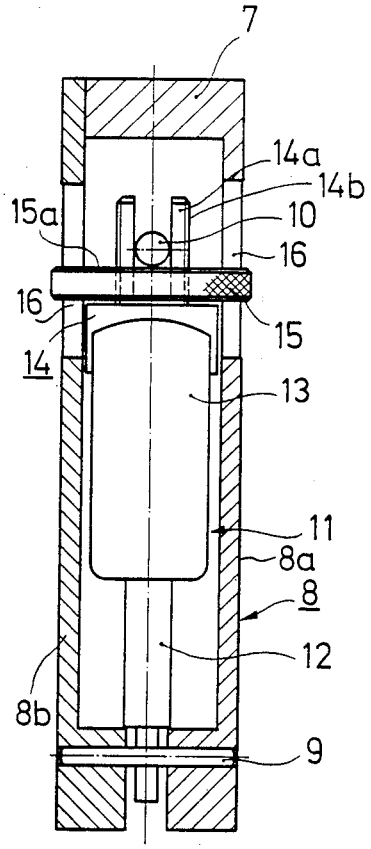
FIG. 3 shows a section along line III—III of FIG. 2.
Figure 2:
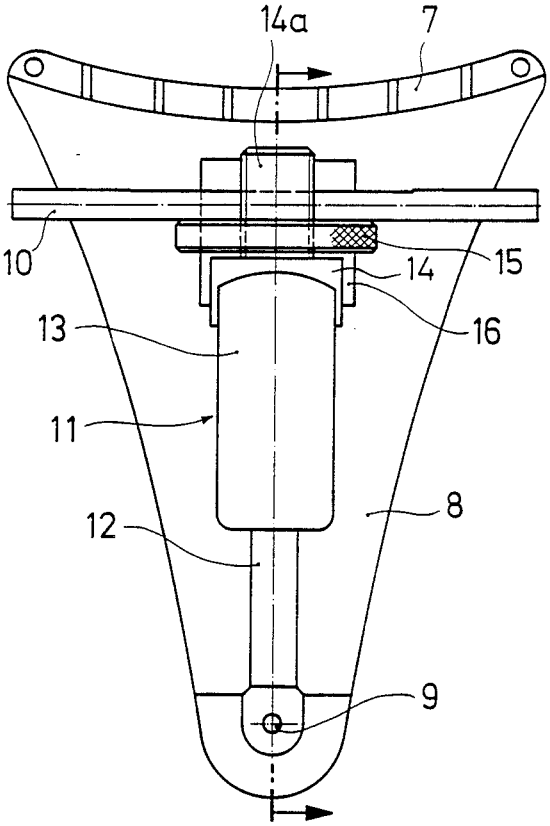
FIG. 2 shows in detail the tensioning device to be located in a cavity of the racket's core.

FIG. 3 clearly shows how little the setting wheel 15 projects beyond the profile of the box 8 while at the same time, in spite of the size of the window 16, permitting easy adjustment of the desired string tension.

It is to be noted that the piston rod member 12 has a relatively large diameter as compared with the inner diameter of the container 13. The relationship of cross-section of the piston member 12 and the cavity within the container 13 is such that as a result of the only very small outward movement of the piston rod 12 with respect to the container 13 resulting from an elongation of the strings 5, the spring force of the gas spring 11 remains substantially constant. Therefore also the tension in the strings 15 remains substantially constant on elongation thereof. On the other hand, the length adjustability of the gas spring resulting from screwing the setting wheel 15 is considerable. Thus in consideration of the relatively large cross-section of the piston rod member 12, a considerable alteration of the spring force can be obtained when screwing the setting wheel 15 from one end to the other end of the window 16. The alteration of the spring force is due to the fact that by inward movement of the piston rod member 12 into the container 13 the pressure of the gas within the container 13 is increased and vice versa.

Figure 4:
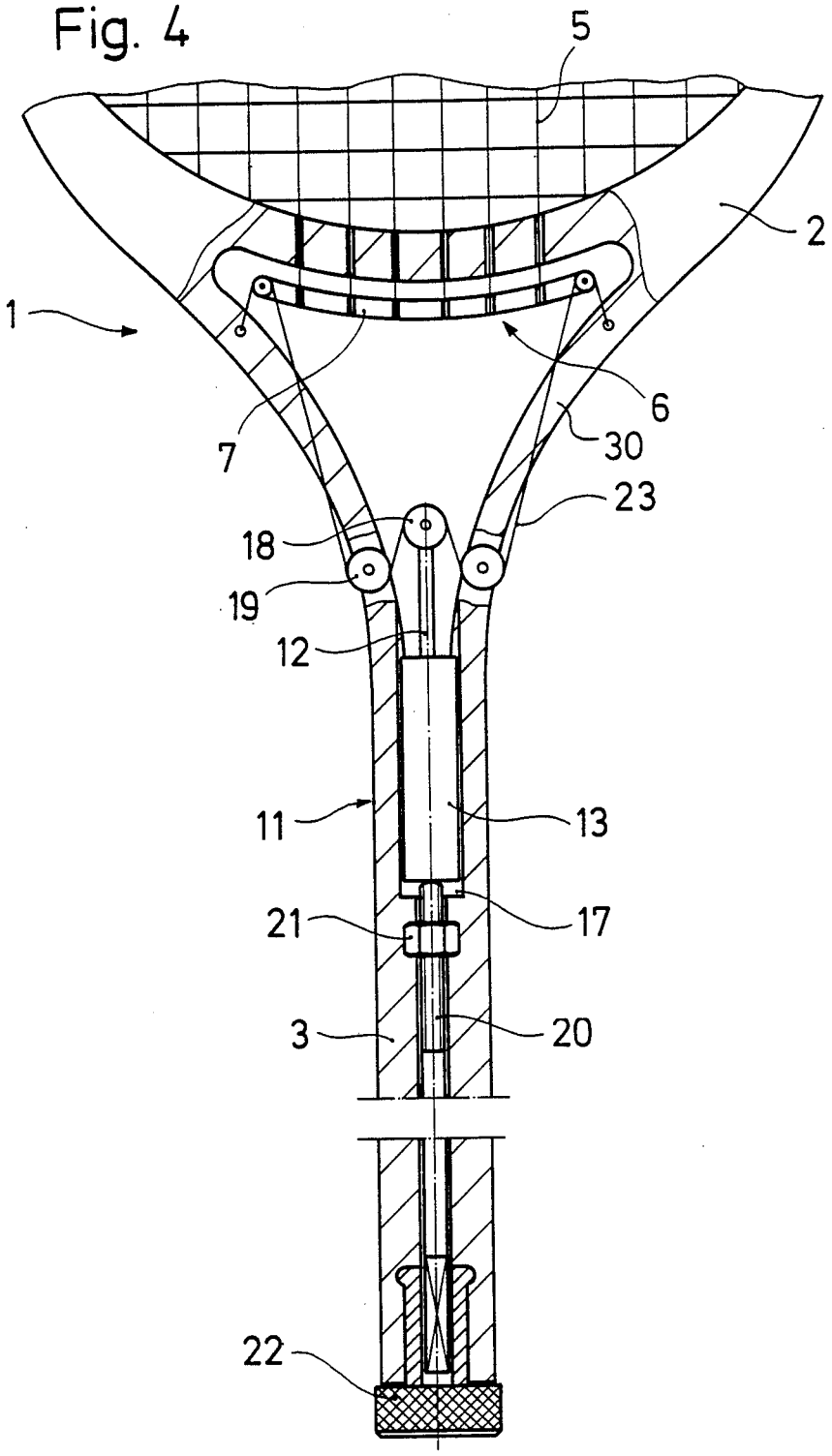
FIG. 4 shows a second embodiment of the invention.

In the embodiment shown in FIG. 4, there is provided in the handle 3 of the racket 1 a cavity 17 in which the container 13 of the gas spring 11 is disposed and is axially displaceable. The bottom of the container 13 is acted upon by the end of the threaded spindle 20 which produces an axial displacement of the gas spring 11 by rotation of the spindle with respect to a spindle nut 21 disposed rigidly in the handle 3. The adjusting wheel 22 on the end of the handle 3 serves to rotate the threaded spindle 20, axial guidance between the adjusting wheel 22 and the screwthreaded spindle 20 being provided, the latter preferably consisting of a square profile on the screwthreaded spindle, engaging the sleeve in the adjusting wheel 22. The adjusting wheel 22 is axially secured by engagement of the sleeve ends into a groove in the handle 3. To exert the tensioning force of the gas-filled spring 11 on some of the logitudinal strings 5, there is once again provided a tensioning member or bridge 7 engaged by some of the longitudinal strings 5. The other side of the tensioning member 7 is engaged by a flexible traction element 23 preferably consisting of a steel cord. This traction element 23 is operatively connected to the gas-filled spring 11 by jockey elements 19 mounted in the racket 1 and one jockey element 18 mounted on the piston rod. Preferably, the jockey elements 18 and 19 consist of direction-deflecting pulleys. By an appropriate adjustment via the adjusting wheel 22, it is possible to vary the tension of the gas spring 11 which acts on the movable tensioning member 7 and so adjust the string tension to the desired value.

Figure 5:
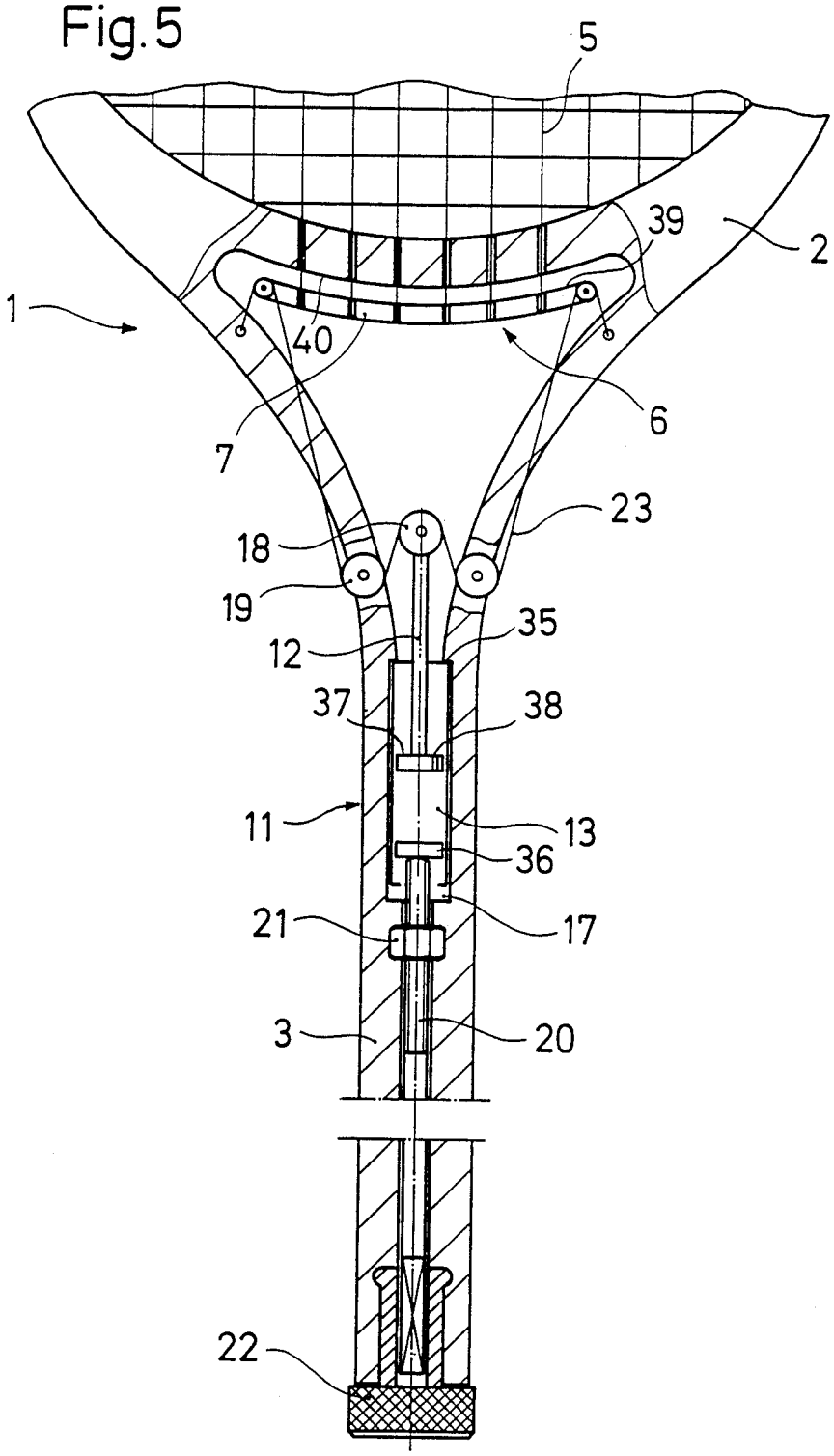
FIG. 5 shows a third embodiment of the invention.

In FIG. 5 there are shown some modifications as compared with FIG. 4. The container 13 abuts an abutment shoulder 35 of the handle member 3. The lower end of the container is defined by a plug member 36 sealingly engaging the inner face of the container 13. The spindle 20 acts against the plug member 36. So the pressure within the container 13 can again be altered by screwing the spindle 20. In this case, the piston rod member 12 can have a very small cross-sectional area, as compared with the cross-sectional area of the cavity within the container 13. This has the advantage that axial movement of the piston rod 12 has very little effect on the magnitude of the pressure within the container 13. So the string tension remains constant even if a considerable elongation of the strings 5 occurs.

In FIG. 5 the piston rod member 12 is provided with a damping piston 37 dividing the cavity within the container 13 into two working chambers. These working chambers are interconnected by a throttling orifice 38. So the movement of the piston rod member 12 with respect to the cylinder 13 is damped.

The tensioning member 7 is provided with an abutment face 39 capable of abutment against a counter-abutment face 40 of the frame member 2. When the stringing is provided on the frame 2, the tensioning member 7 may abut by its face 39 against the counter-abutment face 40. So the stringing can be made in classic manner between rigid anchoring points of the frame member 2. Only after the strings 5 have all been connected to the tensioning member 39, this tensioning member 7 may be subjected to the action of the tensioning device 37, the tensioning force being adjusted by the operating member 22 in accordance with the wishes of the respective player.

While specific embodiments of the invention have been shown and described in detail to illustrate the application of the inventive principles, it will be understood that the invention may be embodied otherwise without departing from such principles.

The reference numerals in the claims are only used for facilitating the understanding and are by no means restrictive.

What is claimed is:

1. A racket for ball games comprising a frame (2) surrounding an internal area, and a plurality of strings (4, 5) extending along said internal area and being under tension, characterized in that at least part of said strings (4, 5) are operatively connected to at least one gas spring tensioning device (11) maintaining said tension of said strings (4, 5), said tensioning device (11) being a component of said racket during the use thereof and being supported by said racket.

2. A racket as set forth in claim 1, a plurality of strings (5) being connected to a common tensioning member (7) provided outside said frame (2), said tensioning member (7) being operatively connected to said tensioning device (11).

3. A racket as set forth in claim 2, said strings (5) connected to said tensioning member (7) being guided through a plurality of bores (31) of said frame member (2), said bores (31) being substantially aligned with said strings (5) connected to said tensioning member (7).

4. A racket as set forth in claim 2, locking means (39, 40) being provided for locking said gas spring tensioning member (7) in a stringing position.

5. A racket as set forth in claim 4, said locking means (39, 40) comprising abutment means.

6. A racket as set forth in claim 1, said racket further comprising a handle member (3) having an axis and being connected with said frame member (2) by an intermediate portion (30).

7. A racket as set forth in claim 6, said internal area having a longitudinal axis substantially parallel to the axis of said handle member (3) and a transverse axis substantially perpendicular to the axis of said handle member (3), a first group of strings (5) extending substantially parallel to said longitudinal axis and a second group of strings (4) extending substantially parallel to said transverse axis, at least part of the strings (5) of said first group of strings (5) being operatively connected to said tensioning device (11).

8. A racket as set forth in claim 7, said strings (5) of said part of strings (5) of said first group being connected to a tensioning member (7) located adjacent to said intermediate portion (30), said tensioning member (7) being operatively connected to said tensioning device (11).

9. A racket as set forth in claim 8, said strings (5) of said part of strings (5) of said first group being guided through bores (31) of an adjacent portion of said frame member (2) towards aid tensioning member (7), said bores (31) being substantially parallel to said longitudinal axis.

10. A racket as set forth in claim 8, said tensioning member (7) being located within a cavity (6) of said intermediate portion (30) adjacent to an adjacent portion of said frame member (2).

11. A racket as set forth in claim 10, said tensioning device (11) being located within a cavity (6, 17) of one of said handle member (3) and said intermediate portion (3) on the side of said tensioning member (7) remote from said frame member (2).

12. A racket as set forth in claim 11, said tensioning device (11) being a thrust-type tensioning device (11).

13. A racket as set forth in claim 12, said thrust-type tensioning device (11) having a first end portion and a second end portion and having an axis substantially parallel to said longitudinal axis, said first end portion (13) being closer to said frame member (2) and supported by said intermediate portion (30) and said second end portion (12) being more remote from said frame member and operatively connected to said tensioning member.

14. A racket as set forth in claim 13, said second end portion (12) of said thrust-type tensioning device (11) acting onto said tensioning member (7) through at least one pulling member (8*a*, 8*b*) extending between said tensioning member (7) and said second end portion (12).

15. A racket as set forth in claim 14, said tensioning member (7) being connected with said second end portion (12) by two pulling plates (8*a*, 8*b*) substantially parallel to said internal area and accommodating said thrust-type tensioning device (11) therebetween, said first end portion (13) of said thrust-type tensioning device (11) being supported on said intermediate portion (30) by a support bar (10) supported on said intermediate portion (30) and extending between said pulling plates (8*a*, 8*b*) across said cavity (6) of said intermediate portion (30) substantially parallel to said transverse axis.

16. A racket as set forth in claim 15, said second end portion (12) of said tensioning device (11) being pivotally connected with said pulling plates (8*a*, 8*b*).

17. A racket as set forth in claim 12, said thrust-type tensioning device (11) being adjustable as to its tensioning force.

18. A racket as set forth in claim 17, said thrust-type tensioning device (11) having an axis substantially parallel to said longitudinal axis and having a first end portion (13) closer to said frame member (2) supported by said intermediate portion (30) and a second end portion (12) remote from said frame member (2) connected to said tensioning member (7) by two pulling plates (8*a*, 8*b*) substantially parallel to said internal area and accommodating said thrust-type tensioning device (11) therebetween, said first end portion (13) of said thrust-type tensioning device (11) being supported on said intermediate portion (30) by a support bar (10) supported on said intermediate portion (30) and extending between said pulling plates (8*a*, 8*b*) across said cavity (6) of said intermediate portion (30) in a direction substantially parallel to said transverse axis, said first end portion (13) of said thrust-type tensioning device (11) being adjustable along said axis of said thrust-type tensioning device (11) with respect to said support bar (10).

19. A racket as set forth in claim 18, said first end portion (13) of said thrust-type tensioning device (11) being supported on said support bar (10) by a base member (14) having a U-shaped fork-portion (14*a*) with fork legs substantially parallel to said internal area and engaging said support bar (10) on both sides thereof, and with a screw member (15) having an end face (15*a*) substantially perpendicular to the axis of said thrust-type tensioning device (11) and also engaging said support bar (10), said screw member (15) being axially movable with respect to said base member (14) by screwing movement about said axis of said thrust-type tensioning device (11), said screw member (14) being accessible through a window (16) of at least one of said pulling plates (8*a*s, 8*b*).

20. A racket as set forth in claim 12, said thrust-type tensioning device (11) having an axis substantially parallel to said longitudinal axis and having a second end portion (13) more remote from said frame member (2), said second end portion (13) being supported by one of said handle member (3) and said intermediate portion (30), a first end portion (12) of said thrust-type tensioning device (11) being connected by at least one flexible pulling member (23) with said tensioning member (7), said flexible pulling member (23) being guided from said first end portion (12) of said thrust-type tensioning device (11) towards said tensioning member (7) via at least one deflection member (19) fixed to one of said handle member (3) and said intermediate portion (30).

21. A racket as set forth in claim 20, said second end portion (13) of said thrust-type tensioning device (11) being adjustable along the axis of said handle member (3).

22. A racket as set forth in claim 21, said second end portion (13) of said thrust-type tensioning device (11) being adjustable along the axis of said handle member (3) by adjustment means (20, 21, 22) extending along the axis of said handle member (3), said adjustment means (20, 21, 22) having an operating member (22) adjacent to the end of said handle member (3) remote from said frame member (2).

23. A racket as set forth in claim 1, said gas spring (11) comprising a cylinder member (13) with a cavity therein and a piston rod member (12) sealingly extending through one end of said cylinder member (13), said cavity receiving volume of pressurized gas, said pressurized gas exerting an outwardly directed spring force onto said piston rod member (12), said piston rod member (12) having a smaller cross-sectional area and said cavity having a larger cross-sectional area, the ratio of said smaller and said larger cross-sectional areas being such that an axial movement of said piston rod member (12) with respect to the cylinder member (13) in response to elongation of the respective strings (5) during operation does not substantially alter the pressure of said pressurized gas within said cavity.

24. A racket as set forth in claim 23, adjustment means (15) being provided for adjustment of the axial position of said piston rod member (12) with respect to said cylinder member (13), said adjustment resulting in an alteration of the gas pressure within said cavity.

25. A racket as set forth in claim 1, said gas spring tensioning device (11) being provided with adjustment means (20, 21, 22) for adjustment of the spring force thereof.

26. A racket as set forth in claim 1, said gas spring tensioning device (11) being provided with damping means (37, 38).

27. A racket as set forth in claim 1, said gas spring tensioning device (11) being a pull-type gas spring.

28. A racket as set forth in claim 1, said gas spring tensioning device (11) being adjustable as to its tensioning force.

29. A racket as set forth in claim 1, said gas spring tensioning device (11) being provided with damping means (37, 38).

30. A racket for ball games comprising a frame (2), said frame surrounding an internal area, and a plurality of strings (4, 5) extending along said internal area and being under tension, at least part of said strings (4, 5) being operatively connected to at least one thrust-type tensioning device (11) maintaining said tension on said strings (4, 5), said tensioning device (11) being a component of said racket during the use thereof and being supported by said racket, said racket further comprising a handle member (3) having an axis and being connected with said frame member (2) by an intermediate portion (30), said internal area having a longitudinal axis substantially parallel to the axis of said handle member (3) and a transverse axis substantially perpendicular to the axis of said handle member (3), a first group of strings (5) extending substantially parallel to said longitudinal axis and a second group of strings (4) extending substantially parallel to said transverse axis, at least part of said first group of strings (5) being operatively connected to a tensioning member (7) located adjacent to said intermediate portion (30), said tensioning member (7) being operatively connected to said tensioning device (11), said part of said first group of strings (5) connected to said tensioning member (7) being guided through bores (31) in said frame member (2) towards said tensioning member (7), said bores (31) being substantially parallel to said longitudinal axis, said tensioning device (11) being located within a cavity (6, 17) of one of said handle member (3) and said intermediate portion (30) on the side of said tensioning member (7) remote from said frame member (2), said tensioning device (11) having an axis substantially parallel to said longitudinal axis and having a first end portion (13) closer to said frame member (2) and supported by said intermediate portion (30) and a second end portion (12) more remote from said frame member and operatively connected to said tensioning member (7) by two pulling plates (8*a*, 8*b*) which are substantially parallel to said longitudinal axis and accommodating said tensioning device (11) therebetween, said first end portion (13) of said tensioning device (11) being supported on said intermediate portion (30) by a support bar (10) supported on said intermediate portion (30) and extending between said pulling plates (8*a*, 8*b*) across said cavity (6) of said intermediate portion (30) substantially parallel to said transverse axis.

31. As racket as set forth in claim 30, wherein said first end portion (13) of said thrust-type tensioning device (11) is adjustable along said axis of said thrust-type tensioning device (11) with respect to said support bar (10) to provide for adjustment of the tensioning force of the tensioning device (11).

* * * * *

UNITED STATES PATENT AND TRADEMARK OFFICE

CERTIFICATE OF CORRECTION

PATENT NO. : 4,976,433

DATED : Dec. 11, 1990

INVENTOR(S) : Pohlenz et al.

It is certified that error appears in the above-identified patent and that said Letters Patent is hereby corrected as shown below:

Col. 1, line 50, after "obtained" insert --in--; line 51, delete the comma after "known"; line 52, delete "to"; line 60, "racket" should read --rackets--. Col. 2, line 5, delete the comma after "preferred"; line 12, "construction" should read --constructed--. Col. 4, line 48, "drawing" should read --drawings--. Col. 5, line 45, delete "also". Col. 7, line 43, "aid" should read --said--; line 65, after "member" insert --(7)--. Col. 8, line 54, "8as" should read --8a--. Col. 9, line 13, after "spring" insert --tensioning device--; line 17, after "receiving" insert --a--.

Signed and Sealed this

Twenty-first Day of July, 1992

*Attest:*

DOUGLAS B. COMER

*Attesting Officer*

*Acting Commissioner of Patents and Trademarks*